US007584912B1

(12) United States Patent
Jiang

(10) Patent No.: US 7,584,912 B1
(45) Date of Patent: Sep. 8, 2009

(54) ANTI-JAM DEVICE THAT RESTRICTS THE NUMBER OF PAPER SHEETS EACH TIME

(75) Inventor: Jia-Wang Jiang, NingBo (CN)

(73) Assignee: Michilin Prosperity Co., Ltd., San Chung, Taipei Hsien (TW)

( * ) Notice: Subject to any disclaimer, the term of this patent is extended or adjusted under 35 U.S.C. 154(b) by 0 days.

(21) Appl. No.: 12/289,047

(22) Filed: Oct. 20, 2008

(51) Int. Cl.
*B02B 1/00* (2006.01)
*B02C 11/08* (2006.01)
*B07B 4/00* (2006.01)

(52) U.S. Cl. ..... 241/36; 241/100; 241/236

(58) Field of Classification Search ..... 241/36, 241/100, 236
See application file for complete search history.

(56) References Cited

U.S. PATENT DOCUMENTS

| | | | | |
|---|---|---|---|---|
| 6,113,017 | A * | 9/2000 | Tsai | 241/236 |
| 6,213,417 | B1 * | 4/2001 | Schwelling | 241/36 |
| 6,682,006 | B2 * | 1/2004 | Lee | 241/36 |
| 7,156,330 | B1 * | 1/2007 | Lo | 241/36 |

* cited by examiner

*Primary Examiner*—Bena Miller
(74) *Attorney, Agent, or Firm*—Bacon & Thomas, PLLC

(57) ABSTRACT

An anti-jam device that restricts the number of sheets each time is disclosed. It comprises a movable element and a fixture element disposed above the rotary shafts. The movable element is a pair of rods parallel to the rotary shafts, with both ends in the preformed holes on the fixing element. When the shredder is in its auto mode, the passage width defined by the gap between the rods is exactly the maximum thickness of paper that can be feded each time. When the shredder is in the rev mode, the rods are pushed by paper upwards to form a larger gap, allowing the paper to be backed out easily.

6 Claims, 3 Drawing Sheets

ANTI-JAM DEVICE THAT RESTRICTS THE NUMBER OF PAPER SHEETS EACH TIME

BACKGROUND OF THE INVENTION

1. Field of Invention

The invention relates to a shredder. In particular, the invention relates to an anti-jam device for the shredder. In the AUTO mode, the passage width provided by the anti-jam device is exactly the maximum thickness of paper that can be fed each time. In the REV mode, the anti-jam device provides a larger passage width for the paper to be backed out easily.

2. Related Art

To prevent such documents as legal files, receipts, invoices, credit card numbers, research reports, or personal financial information (e.g., credit card and phone bills) from being released, it is common to destroy them using a shredder. Therefore, the shredder has become an indispensable device for both business and home applications.

The action principle of a shredder for shredding paper is to dispose several cutting blades on two rotary shafts with spacers in between. A motor and a gearbox are employed to drive the two parallel rotary shafts that rotate in opposite directions. They provide a shearing force on passing paper to cut it into small stripes.

The motor load and the strength of the cutting blades and rotary shafts limit the sheet capacity allowed by the shredder each time. That is, when many paper sheets need to be destroyed, the user has to limit the amount of paper each time. Otherwise, there may be paper jam occurring to the rotary shafts. Therefore, in order not for the user to put in too much paper at a time, it is necessary to provide an anti-jam device that automatically restricts the number of sheets.

SUMMARY OF THE INVENTION

An objective of the invention is to provide an anti-jam device that restricts the number of sheets each time. In the auto mode, the provided passage width is exactly the maximum thickness of paper that can be fed each time. In the rev mode, the anti-jam device provides a larger passage width for the paper to be backed out easily.

In accord with the above-mentioned objective, the disclosed anti-jam device comprises a movable element and a fixing element disposed above the rotary shafts of the shredder. The movable element is a pair of rod parallel to the rotary shafts, with both ends in the holes preformed on the fixing element. When the shredder is in its auto mode, the passage width provided by the rap between the rods is exactly the maximum thickness of paper that can be fed each time. In the rev mode, the rods are pushed upwards by the paper to render a larger passage width for the paper to be backed out easily.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

Figures 1, 2:
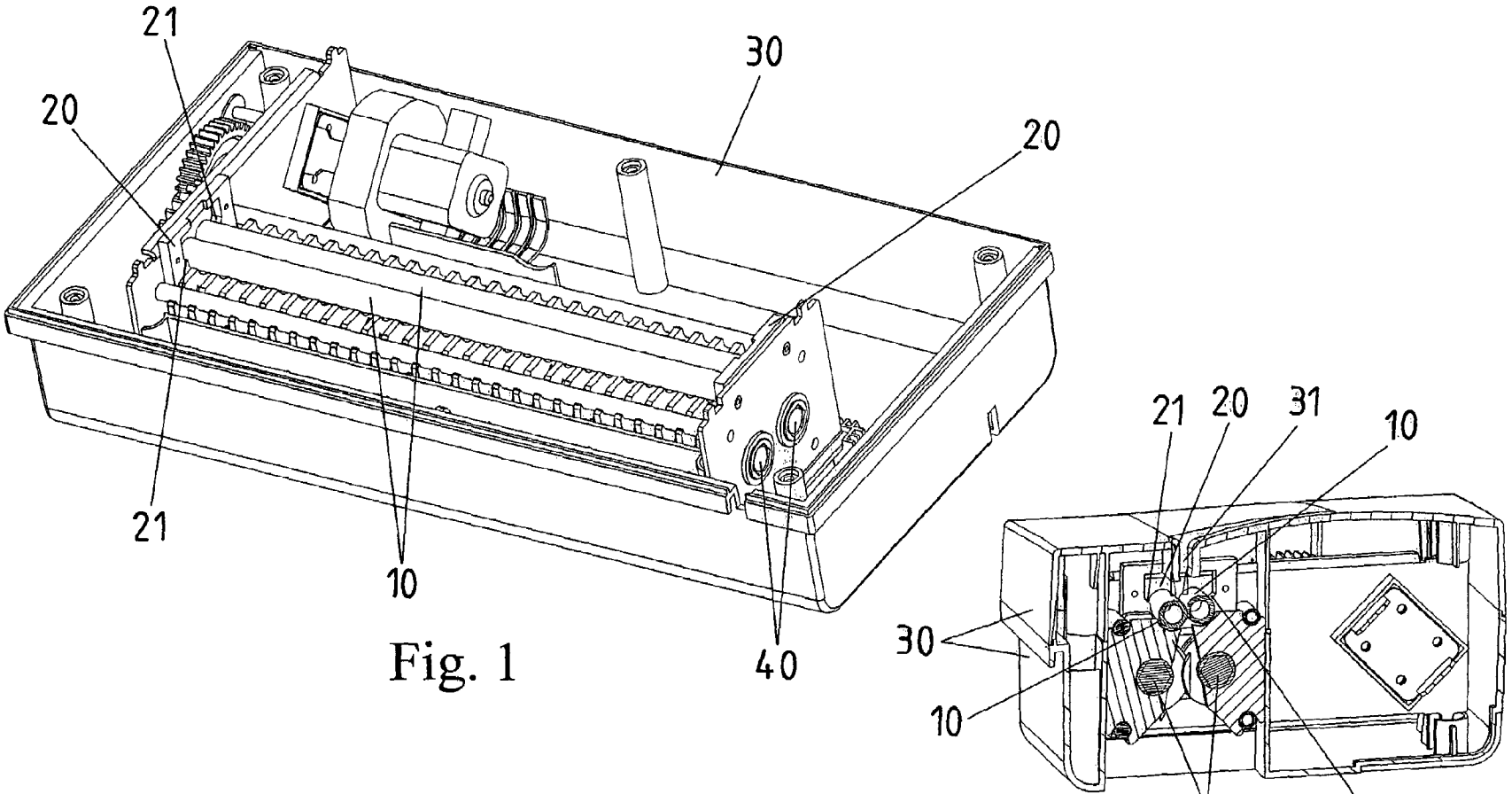
FIG. 1 shows the appearance of the first embodiment according to the invention.
FIG. 2 is a locally enlarged view of FIG. 1.

The present invention will be apparent from the following detailed description, which proceeds with reference to the accompanying drawings, wherein the same references relate to the same elements.

The discloses shredder includes a housing 30, a shredder opening 31 on the top surface of the housing for material such as paper to be fed in, and a shredder mechanism disposed inside the housing 30 for shredding the material. The shredder mechanism includes cutting blades mounted on the rotary shafts 40. A motor and a gearbox drive the two parallel rotary shafts that run in opposite directions. The material being fed is then to cut into chips. The disclosed anti-jam device is disposed between the rotary shafts 40 and the shredder opening 31, composed of a movable element 10 and a fixing element 20.

FIG. 1 shows the appearance of a first embodiment of the invention. FIG. 2 shows the local structure of FIG. 1. The movable element 10 is a pair of rods parallel to the rotary shafts 40. Both ends of each rod fall into preformed holes 21 of the fixing element 20. Normally, the movable element 10 is at the bottom of the hole 21. As shown in the drawing, the hole 21 has an open space for the movable element 10 to move. When the shredder is in its auto mode, the passage width provided by the gap between the rods above the rotary shafts 40 is exactly the maximum thickness of paper that is allowed by the shredder each time. Therefore, only when the thickness of paper fed each time is smaller than the passage width can it pass through. When the shredder is in its rev mode, the rods of the movable element 10 are pushed upwards by the paper so that the rods move toward the open space in the upper part of the holes 21. The passage width thus becomes larger for the paper to be backed out conveniently.

Figures 3, 4:
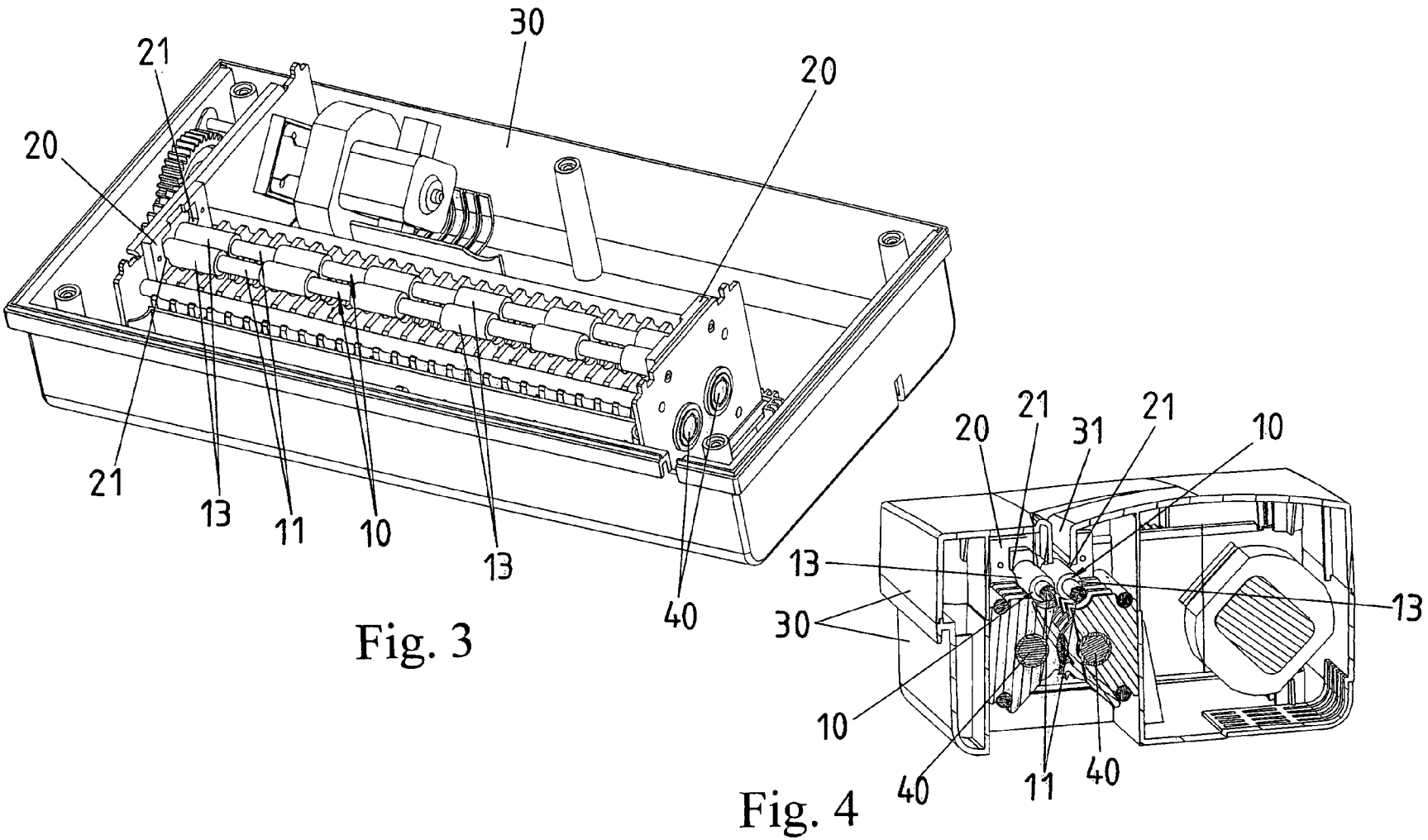
FIG. 3 shows the appearance of the second embodiment according to the invention.
FIG. 4 is a locally enlarged view of FIG. 3.

In the first embodiment, the rods in the movable element 10 can be metal or plastic hollow tubes or solid bars. To save the material, the second embodiment shown in FIGS. 3 and 4 has rods 11 in smaller diameters and mounted with plastic rings 13. The plastic rings 13 are provided in a symmetric way on the rods 11. Therefore, the passage width provided by the gap between the plastic rings 13 is exactly the maximum thickness of paper allowed by the shredder each time. Only when the thickness of paper fed each time is smaller than the passage width can it pass through. When the shredder is in its rev mode, the plastic rings 13 in the movable element 10 are pushed upwards by the paper so that the rods 11 move towards the open space in the upper portion of the holes 21. Consequently, the passage width between the plastic rings 13 becomes larger for the paper to be backed out conveniently.

Figure 6:
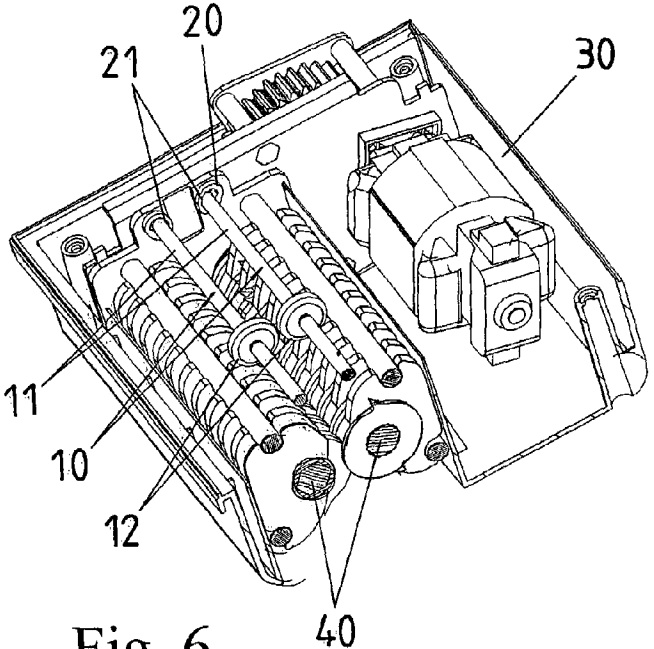
FIG. 6 is a locally enlarged view of FIG. 5.
Figure 5:
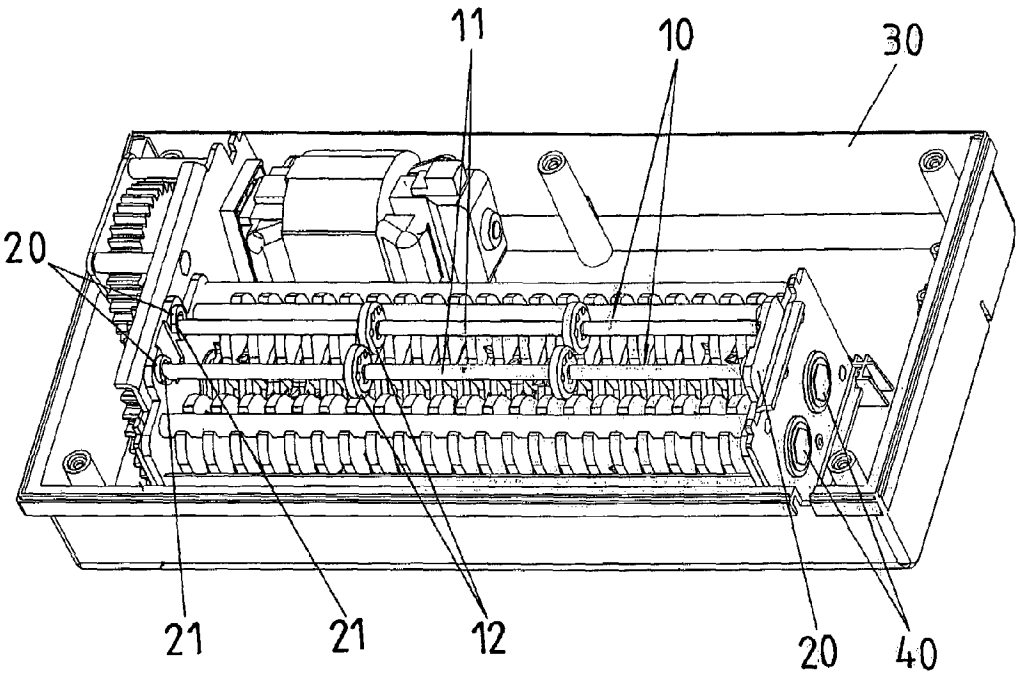
FIG. 5 shows the appearance of the third embodiment according to the invention.

The symmetrically disposed plastic rings 13 in the movable element 10 of the second embodiment can be replaced by plastic or metal rollers 12, as shown in FIGS. 5 and 6 of a third embodiment. In this case, the passage width provided by the gap between the rollers 12 is exactly the maximum thickness of paper allowed by the shredder each time. Only when the thickness of paper fed each time is smaller than the passage width can it pass through. When the shredder is in its rev mode, the rollers 12 in the movable element 10 are pushed upwards by the paper so that the rods 11 move towards the open space in the upper portion of the holes 21. Consequently, the passage width between the rollers 12 becomes larger for the paper to be backed out conveniently.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An anti-jam device that restricts the number of paper sheets entering a shredder having a housing whose top surface has a shredder opening and a shredder mechanism that includes a pair of parallel rotary shafts driven by a motor and gearbox and rotating in opposite directions, cutting blades mounted on the rotary shafts to cut the paper into stripes, the anti-jam device comprising:

a movable element, which includes a pair of rods disposed between and in parallel with the shredder opening and the rotary shafts;

a fixing element, which supports both ends of each rod and has holes that are larger than the diameter of the rod ends;

wherein in the auto mode of the shredder, the rods in the movable element are at the bottom of the holes on the fixing element and the minimum gap between the rod restricts the maximum thickness of the paper allowed each time and, in the rev mode, the rods are pushed upwards by the paper to move into an open space in an upper portion of the holes so that the passage width between the rods becomes larger for the paper to be backed out conveniently.

2. The anti-jam device of claim 1, wherein the rods in the movable element are hollow tubes or solid bars made of material selected from the group consisting of metal and plastic.

3. The anti-jam device of claim 1, wherein the rods in the movable element are mounted with plastic rings.

4. The anti-jam device of claim 3, wherein the plastic rings are symmetrically disposed on the rods and the passage width provided by the gap between the rollers is the maximum thickness allowed by the shredder each time.

5. The anti-jam device of claim 1, wherein the rods in the movable element are mounted with rollers.

6. The anti-jam device of claim 5, wherein the rollers are symmetrically disposed on the rods and the passage width provided by the gap between the rollers is the maximum thickness allowed by the shredder each time.

* * * * *